US008978287B1

(12) United States Patent
Riley

(10) Patent No.: US 8,978,287 B1
(45) Date of Patent: Mar. 17, 2015

(54) ELEVATED GUN SIGHTING DEVICE FOR HITTING MOVING TARGETS

(71) Applicant: Jimmy Patrick Riley, Milton, FL (US)

(72) Inventor: Jimmy Patrick Riley, Milton, FL (US)

( * ) Notice: Subject to any disclaimer, the term of this patent is extended or adjusted under 35 U.S.C. 154(b) by 0 days.

(21) Appl. No.: 13/932,363

(22) Filed: Jul. 1, 2013

Related U.S. Application Data

(60) Provisional application No. 61/763,855, filed on Feb. 12, 2013.

(51) Int. Cl.
*F41G 1/473* (2006.01)

(52) U.S. Cl.
CPC ..... *F41G 1/473* (2013.01)
USPC ..... 42/141

(58) Field of Classification Search
USPC ..... 42/112, 113, 124, 130, 133, 141
See application file for complete search history.

(56) References Cited

U.S. PATENT DOCUMENTS

| | | | | | |
|---|---|---|---|---|---|
| 1,835,938 | A | * | 12/1931 | Ewen | 42/144 |
| 2,056,469 | A | * | 10/1936 | King | 42/140 |
| 2,333,514 | A | * | 11/1943 | Beresky | 42/133 |
| 2,519,220 | A | * | 8/1950 | Bentley | 42/141 |
| 2,904,888 | A | * | 9/1959 | Niesp | 42/141 |
| 3,187,724 | A | | 4/1965 | Callihoe | |
| 4,008,536 | A | * | 2/1977 | Adams | 42/112 |
| 4,112,583 | A | | 9/1978 | Castilla | |
| 4,745,686 | A | * | 5/1988 | Willis | 42/136 |
| 5,054,204 | A | | 10/1991 | Ward et al. | |
| D376,406 | S | * | 12/1996 | Rosen et al. | D22/109 |
| 6,804,908 | B1 | | 10/2004 | Hanson et al. | |
| 7,328,531 | B2 | | 2/2008 | Dietz | |
| 7,621,065 | B2 | | 11/2009 | Gablowski | |
| 2005/0086848 | A1 | * | 4/2005 | Dietz | 42/130 |

* cited by examiner

*Primary Examiner* — Bret Hayes

(74) *Attorney, Agent, or Firm* — John R Casperson

(57) ABSTRACT

A shotgun sight for mounting to the end of a shotgun barrel comprises a clear plate having a pin extending generally normally from the plate back toward the eye of the shooter and parallel to the axis of the barrel. The plate has a circle surrounding the base of the pin to facilitate proper eye positioning for use of the plate as a sighting device and a dot marked on the plate between the pin and the barrel to serve as an elevation mark. Arcs marked on the plate centered on the pin serve as lead indicators for moving targets.

17 Claims, 14 Drawing Sheets

Top View

Side View 1
6
7
13
Top View

D1
D2
Side View 5
12
95
60
45
4
75
80
85
9
8
9'
7
70
65
10
11
110
90
105'
105
100
Front View

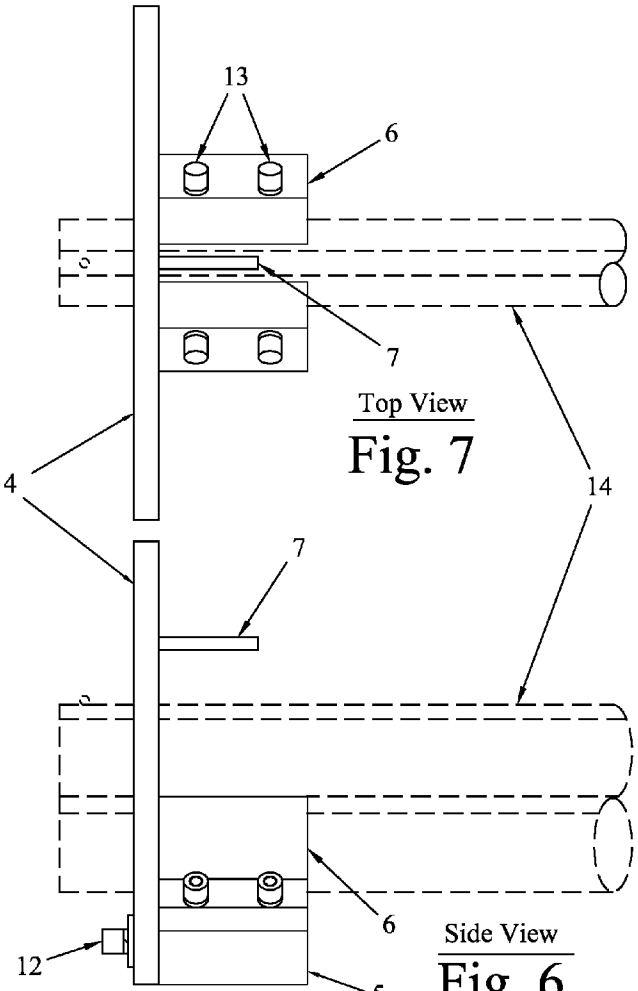
Top View
Fig. 7
Side View
Fig. 6
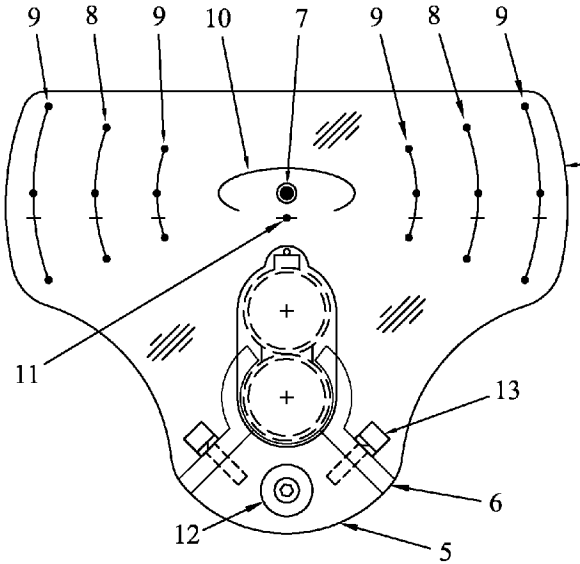
Front View
Fig. 8

Top View

Side View

Front View

Top View

Side View

Front View

Side View

Front View

Side View

Front View

Top View

Side View

ELEVATED GUN SIGHTING DEVICE FOR HITTING MOVING TARGETS

CROSS REFERENCES TO RELATED APPLICATIONS

This application claims the benefit of U.S. Provisional Application No. 61/763,855 filed 12 Feb. 2013, the disclosure of which is incorporated by reference herein.

FIELD OF THE INVENTION

In one aspect, the invention relates to a sighting device for a shotgun. In another aspect, the invention relates to a non-optical, non-electronic shotgun sight for hitting moving targets.

BACKGROUND OF THE INVENTION

Hunters and target shooters alike have always been intrigued by the challenge of wing hunting and target shooting using moving targets. Some shooters will tell you that they simply point the gun ahead of the target and do not sight with one eye closed while others will tell you just the opposite that they actually do sight with one eye closed. Despite the method of sighting, missing the target is much more likely than hitting the target.

One of the challenges associated with the shooting of moving targets such as game birds for example, are the constantly changing variables such as the bird's speed, distance, altitude, angle of flight and even the size of bird itself. For example; younger birds are naturally smaller in size than older birds not to mention the different species of the bird that can also make a difference in their size and shape. Notwithstanding all these changing variables, the shooter must still be able to quickly analyze and calculate the correct lead angle before each shot.

Another critical issue that confronts the shooter on every shot is their ability to level the gun barrel onto the flight path of the moving target. Some shooters simply take for granted that the gun barrel is level enough if the rib and sight appear somewhat flat from the shooter's perspective. This phenomenon alone is the reason for many missed shots not to mention all the other variables involved. Example: a gun barrel one (1) degree higher out of level to the intended target will move the shot pattern approximately 18" higher at a range of approximately 30 yards.

Notwithstanding all the issues involved before each shot, the shooter must still be able to shoulder his weapon, level the gun barrel onto the correct flight path of the target, calculate the correct lead angle and fire up to three (3) consecutive shots in approximately three (3) seconds. Three (3) seconds considered by many to be the average time it takes the target to travel through the firing zone.

Other gun sights and gun sighting devices such as those described in U.S. Pat. Nos. 3,178,824 and 7,328,531 B2 and other variants, are problematic for a number of reasons some of which are pointed out below:

The first problematic issue with prior art is their use of complex lines and angled indicators that the shooter must navigate through before they can acquire a firing solution. Considering that most shooters would only have a few seconds, it would be very difficult to navigate through the field of indicators and lines in order to make a logical choice for the first shot. Any subsequent shots would even be more problematic.

The second problematic issue is the reliance on target size as the means of selecting the appropriate target indicator.

Considering that most targets are extremely small from the shooters vantage point, it would be difficult for the shooter to make split second decisions based on target size.

The third problematic issue is the use of the existing gun barrel sight as the primary gun sight for the device. Attaching and surrounding the existing gun sight with additional devices only exacerbates the difficulty of sighting and leveling the gun barrel while using the existing gun barrel sight.

OBJECTS OF THE INVENTION

This inventive idea is a small and compact gun sighting device that is designed to meet many of the challenges associated with hitting moving targets, such as wing hunting and target shooting using moving targets. This device can be attached and removed quickly and easily from the gun barrel and can be manufactured to fit most of the shotguns available and on the market today.

SUMMARY OF THE INVENTION

One embodiment of the invention provides an aiming plate for a shotgun. The aiming plate comprises a clear plate having a borehole penetration near a periphery of the plate and an aiming point generally centrally located on the plate. A cutout is provided between the borehole and the aiming point sized to receive a shotgun barrel. A line drawn between the borehole and the aiming point forms a line of symmetry for generally sickle-shaped markings on the plate to indicate lead for a moving target. The pair of generally sickle-shaped markings is made on the plate concentrically around the aiming point and symmetrically with respect to the line of symmetry for indicating lead for a moving target.

One embodiment of the invention provides a shotgun sight comprising a clear plate, a pin and a mounting means. The pin provides an aiming point. The pin extends generally normally from the plate and has a first diameter and a longitudinal axis. The mounting means is attached to the plate for mounting the plate to a shotgun comprising a barrel having a second diameter, the barrel having a longitudinal axis positioned parallel to the longitudinal axis of the pin.

When affixed to a shotgun, alignment of the pin with the eye of the shooter indicates a line of vision closely parallel to the bore of the shotgun and permits the pin to serve as a sighting device as well as a locator to permit the eye of the shooter to function as a rear sight, making possible the use of additional targeting markings on the shotgun sight.

If desired, a middle sight can be mounted near a midsection of the shotgun barrel. The middle sight comprising a second clear plate having a notch on its upper periphery to facilitate proper head positioning by the shooter by alignment of the notch with the sighting mark on the front plate. The longitudinal axis of the barrel is generally parallel to a line drawn between the notch and the sighting mark to facilitate hitting the target.

BRIEF DESCRIPTION OF THE DRAWINGS

FIG. 6 shows an enlarged side view of the support saddle embodiment attached to a generic over and under shotgun to better understand the different parts of the embodiment and how it attaches to the barrel. The support saddle is secured to bottom portion of the lower barrel and compressed in place by the side barrel attachment clamps. The sight plate containing the multi-function sight, optimal sights, marginal sights, slow target sights and drop compensation sight is then attached to the support saddle and further aligned with the barrel.

FIG. 7 shows a side view of FIG. 6 for clarity.

FIG. 8 shows an enlarged front view (muzzle end) of the embodiment depicted in FIGS. 6 and 7. In addition to showing how the embodiment is attached, this view also shows the position and layout of the multi-function sight as well as the optimal, marginal, slow target and drop compensation sights.

DETAILED DESCRIPTION OF THE INVENTION

Figures 1, 2:
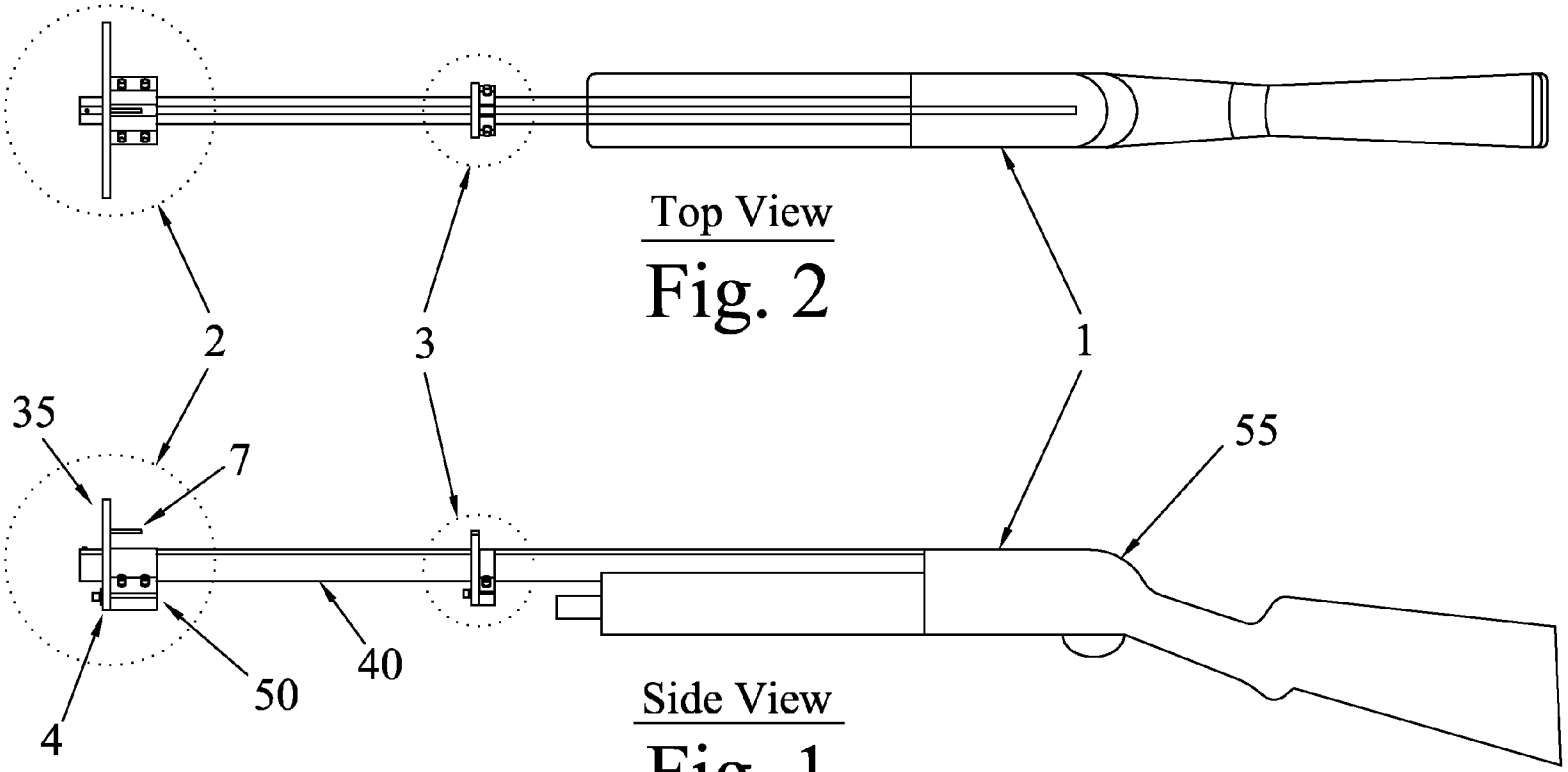
FIG. 1 shows a side view of one preferred embodiment and support sight that attaches to barrel using the support saddle with side barrel attachment clamps. It is shown being attached to a generic single barrel shotgun silhouette for the purpose of giving the reviewer a more realistic perspective
FIG. 2 shows the top view of the same embodiment depicted in FIG. 1
Figures 3, 4, 5:
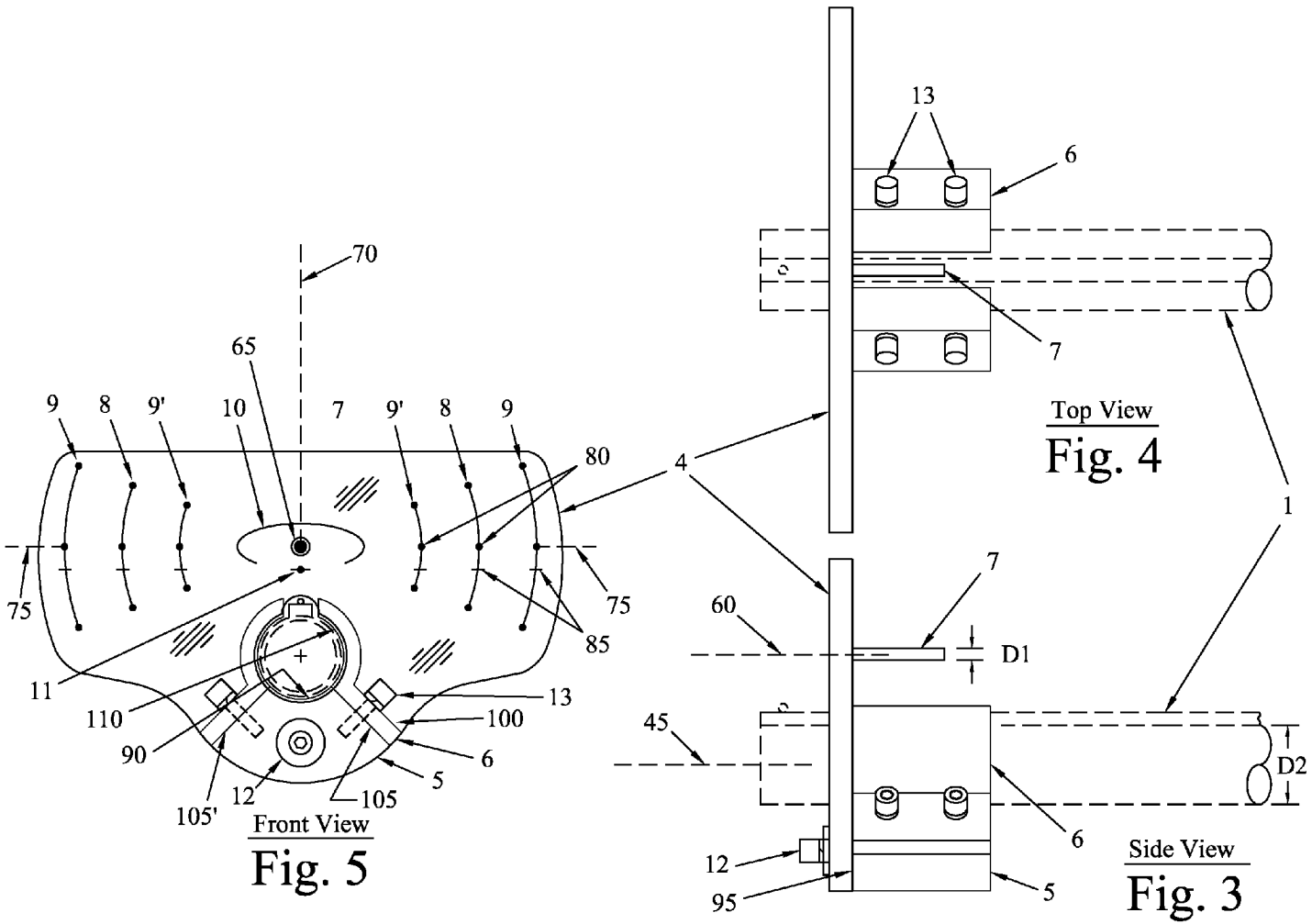
FIG. 3 shows an enlarged side view of the support saddle embodiment attached to a generic single barrel shotgun to better understand the different parts of the embodiment and how it attaches to the barrel. The support saddle is secured to bottom portion of the barrel and compressed in place by the side barrel attachment clamps. The sight plate containing the multi-function sight, optimal sights, marginal sights, slow target sights and drop compensation sight is then attached to the support saddle and further aligned with the barrel.
FIG. 4 shows an enlarged top view of same embodiment depicted in FIG. 3.
FIG. 5 shows an enlarged front view (muzzle end) of the embodiment depicted in FIGS. 3 and 4. In addition to showing how the embodiment is attached, this view also shows the position and layout of the multi-function sight as well as the optimal and marginal, slow target and drop compensation sights.

One embodiment of the invention provides a shotgun sight 35 comprising a clear plate 4, a pin 7 and a mounting means 50. The pin extends generally normally from the plate and has a first diameter and a longitudinal axis. The mounting means is attached to the plate for mounting the plate to a shotgun 55 comprising a barrel 40 having a second diameter. See FIG. 1. The barrel has a longitudinal axis 45 positioned parallel to the longitudinal axis 60 of the pin. See FIG. 3.

Generally speaking, the second diameter will be in the range of 3 to 30 times larger than the first diameter, usually in the range of 5 to 15 times larger than the first diameter.

Figures 9, 10, 11:
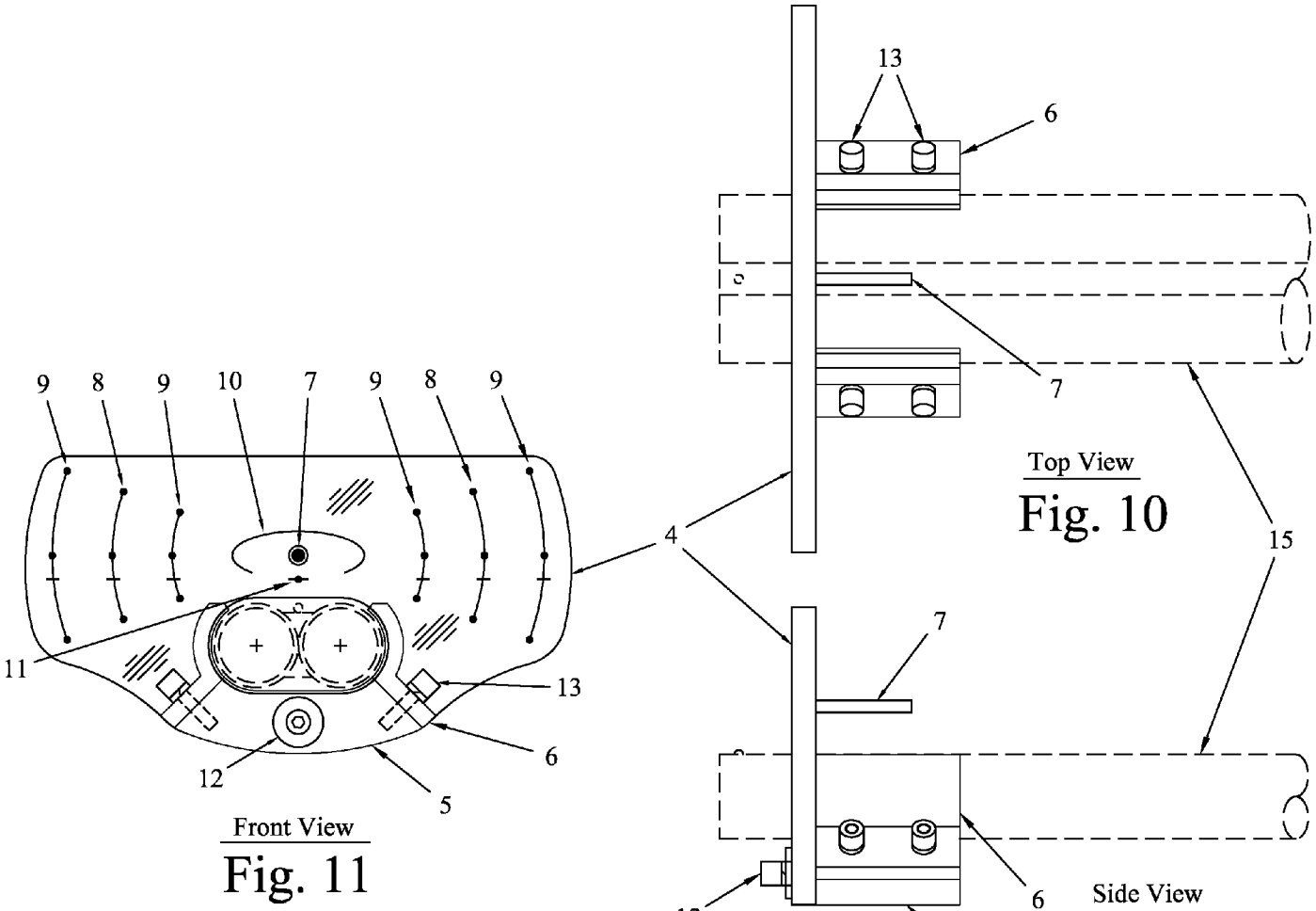
FIG. 9 shows an enlarged side view of the support saddle embodiment attached to a generic double barrel shotgun to better understand the different parts of the embodiment and how it attaches to the barrel. The support saddle is secured to bottom portion of the barrels and compressed in place by the side barrel attachment clamps. The sight plate containing the multi-function sight, optimal sights, marginal sights, slow target sights and drop compensation sight is then attached to the support saddle and further aligned with the barrel.
FIG. 10 shows the enlarged top view of same embodiment depicted in FIG. 9.
FIG. 11 shows an enlarged front view (muzzle end) of the embodiment depicted in FIGS. 9 and 10. In addition to showing how the embodiment is attached, this view also shows the position and layout of the multi-function sight as well as the optimal, marginal, slow target and drop compensation sights.
Figures 12, 13, 14:
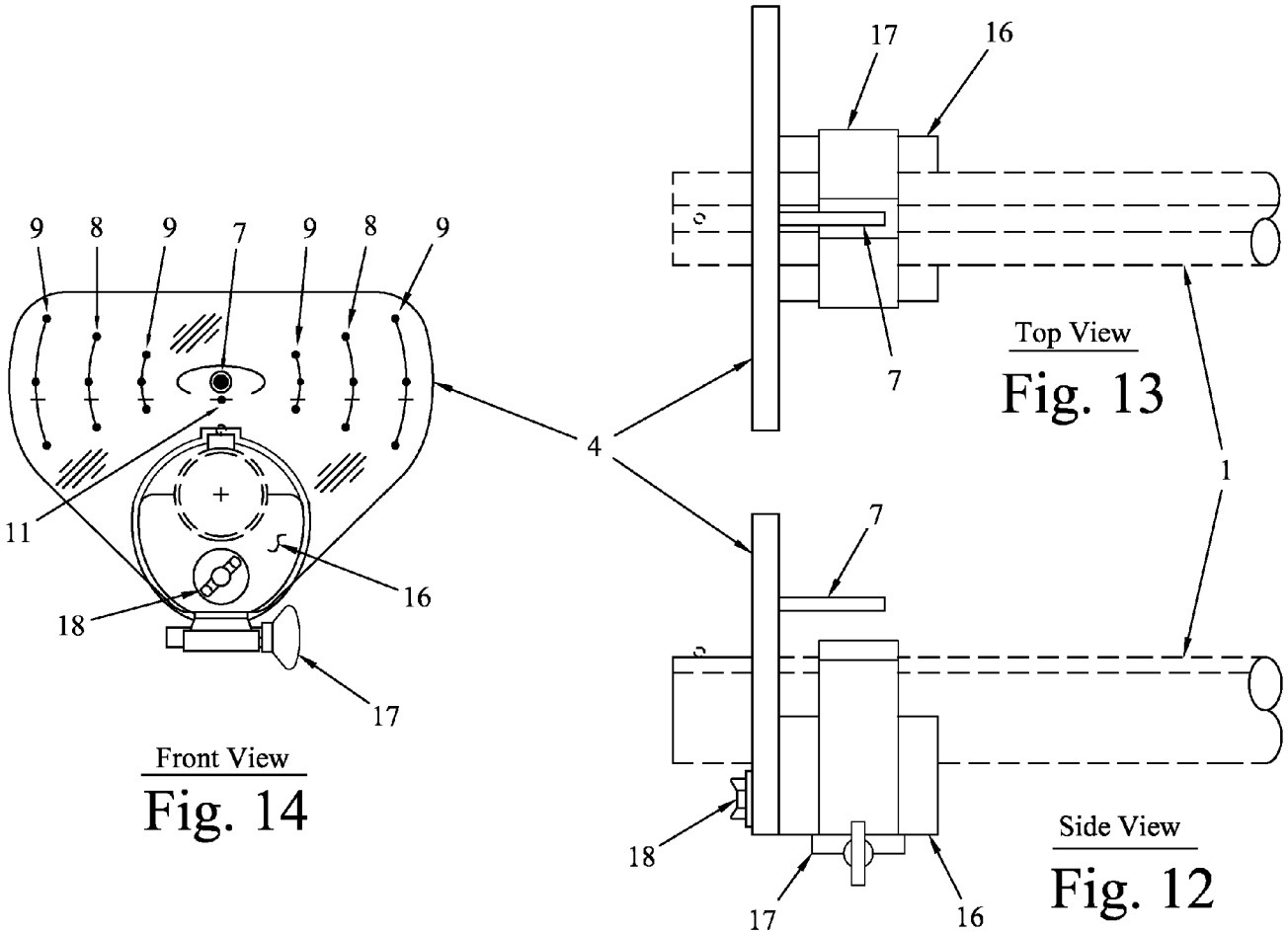
FIG. 12 shows an enlarged side view of the support saddle embodiment attached to a generic single barrel shotgun to better understand the different parts of the embodiment and how it attaches to the barrel. The support saddle is secured to bottom portion of the barrel and compressed in place by the adjustable attachment clamp. The sight plate containing the multi-function sight, optimal sights, marginal sights, slow target sights and drop compensation sight is then attached to the support saddle and further aligned with the barrel.
FIG. 13 shows the enlarged top view of same embodiment depicted in FIG. 12.
FIG. 14 shows an enlarged front view (muzzle end) of the embodiment depicted in FIGS. 12 and 13. In addition to showing how the embodiment is attached, this view also shows the position and layout of the multi-function sight as well as the optimal, marginal, slow target and drop compensation sights.
Figure 15:
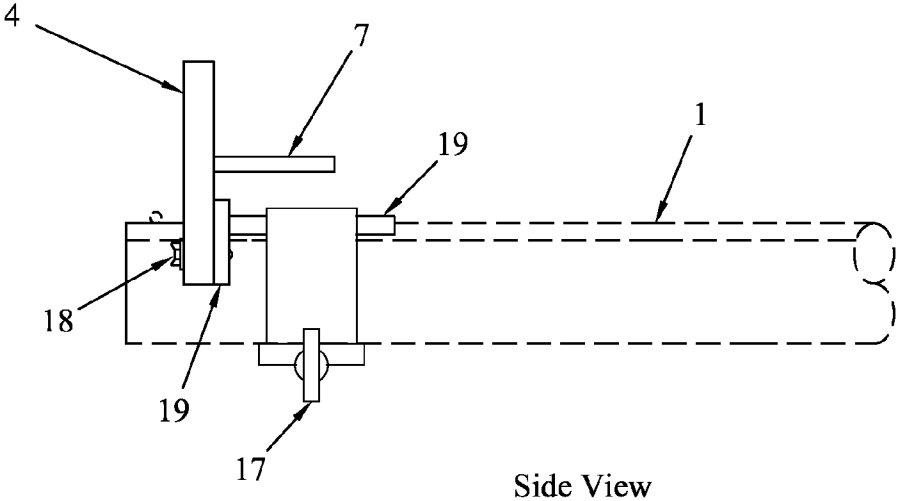
FIG. 15 shows a side view of the rib mount embodiment to better understand the different parts and to show how it attaches to the rib and barrel. The support bracket for this embodiment is designed to saddle the rib and secured in place with the adjustable clamp. The front side of the support bracket is designed so that the sight plate can be easily attached, removed, or exchanged.
Figure 16:
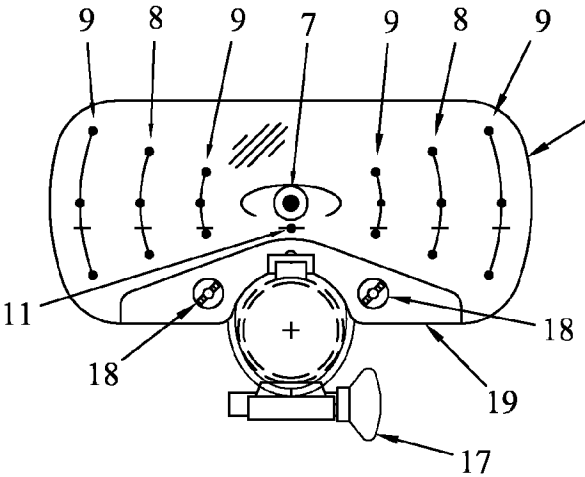
FIG. 16 shows the front view of the rib mount embodiment as depicted in FIG. 15. In addition to showing how the embodiment is attached, this view also shows the position and layout of the multi-function sight as well as the optimal, marginal, slow target and drop compensation sights.
Figure 17:
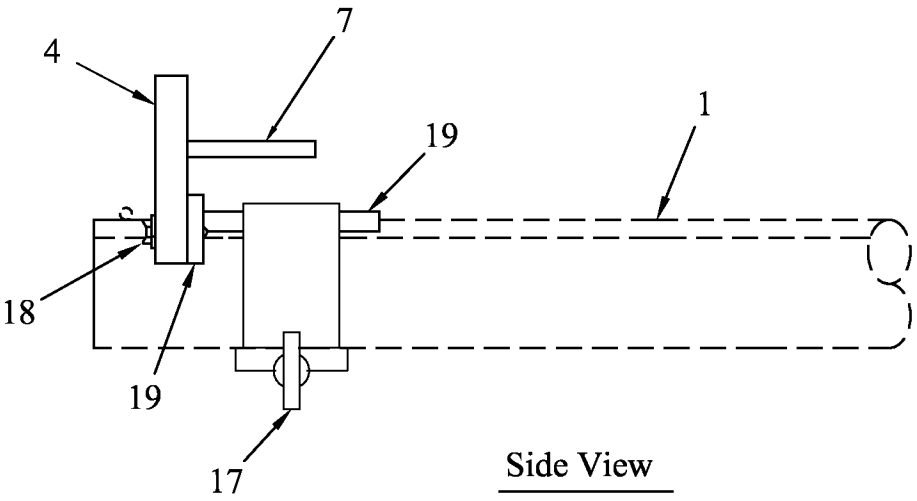
FIG. 17 shows the side view of the rib mount embodiment which only includes the multi-function sight. This sight embodiment would be an excellent choice for all types of moving and stationary targets
Figure 18:
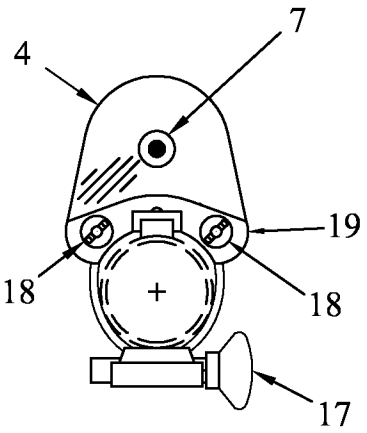
FIG. 18 shows the front view of the rib mount embodiment as depicted in FIG. 17. In addition to showing how the embodiment is attached, this view also shows the position of the multi-function sight.
Figures 19, 20:
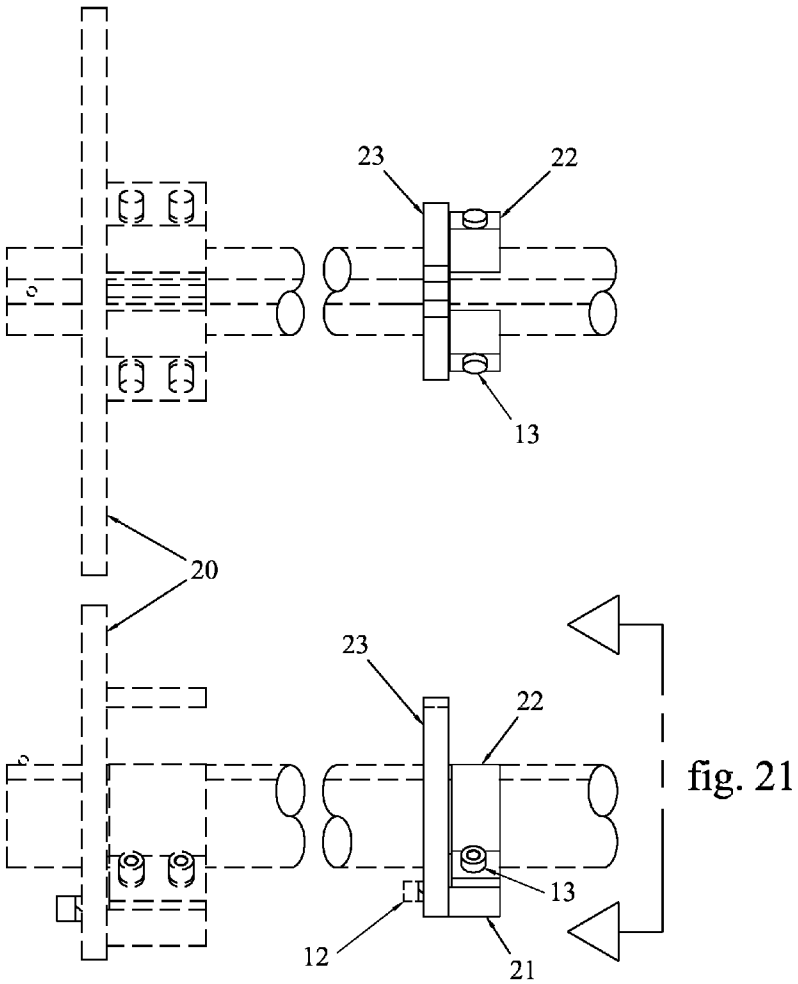
FIG. 19 shows an enlarged side view of the mid barrel support sight to show how it attaches to the barrel and in relation to the main sight. The support sight attaches to the barrel similarly to the main sight and the top of the support sight is aligned with the multi-function sight. This sight may also be used with all other embodiments and types of shotguns.
FIG. 20 shows an enlarged top view of FIG. 19
Figure 22:
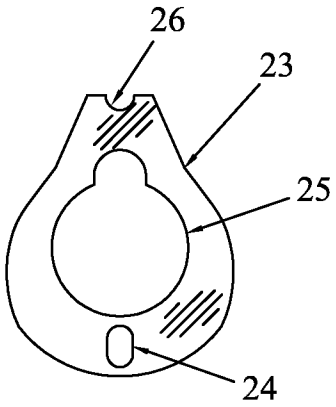
FIG. 22 shows the support sight separate of the barrel attachment to show clarity.
Figure 21:
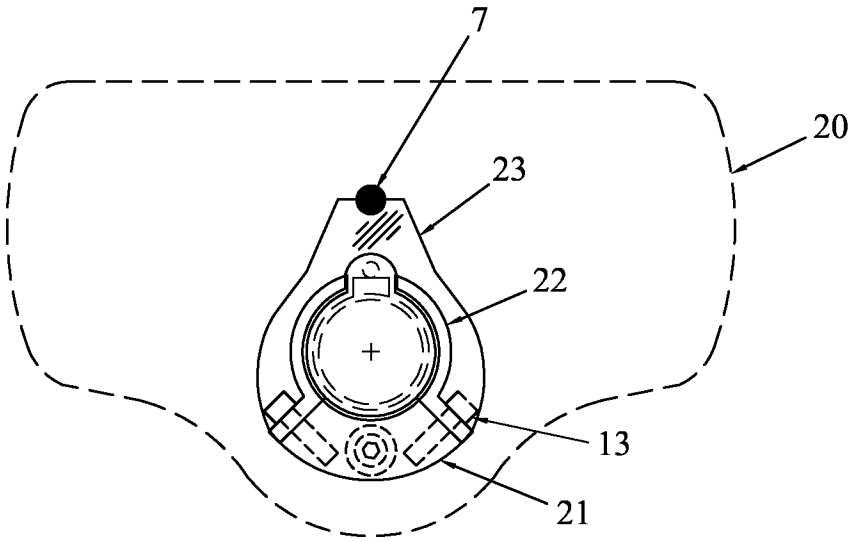
FIG. 21 shows forward looking cross section of FIG. 19 showing the relationship between the support sight and the multi-function sight.
Figure 24:
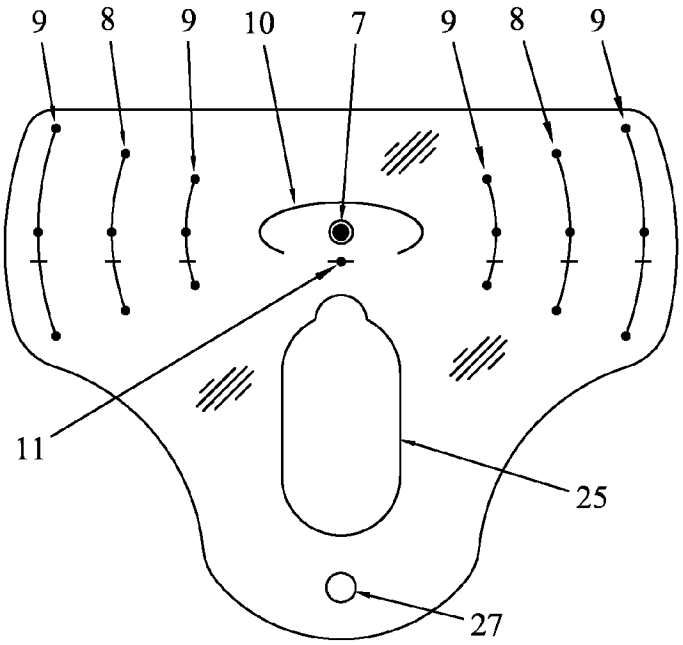
FIG. 24 shows one type of over and under sight plate separate of the barrel attachment to show clarity.
Figure 23:
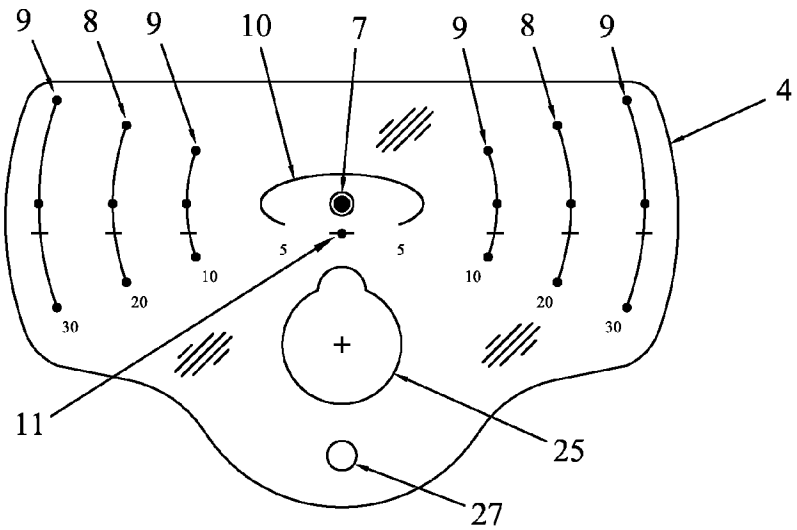
FIG. 23 shows one type of single barrel sight plate separate of the barrel attachment to show clarity. The arcs are labeled with apparent lateral speed markings in mph. Speed markings can be used in all embodiments if desired.
Figure 26:
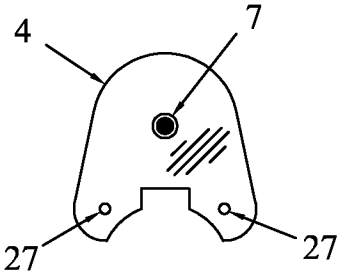
FIG. 26 shows the stand alone multi-function sight plate separate of the attachment bracket to show clarity.
Figure 25:
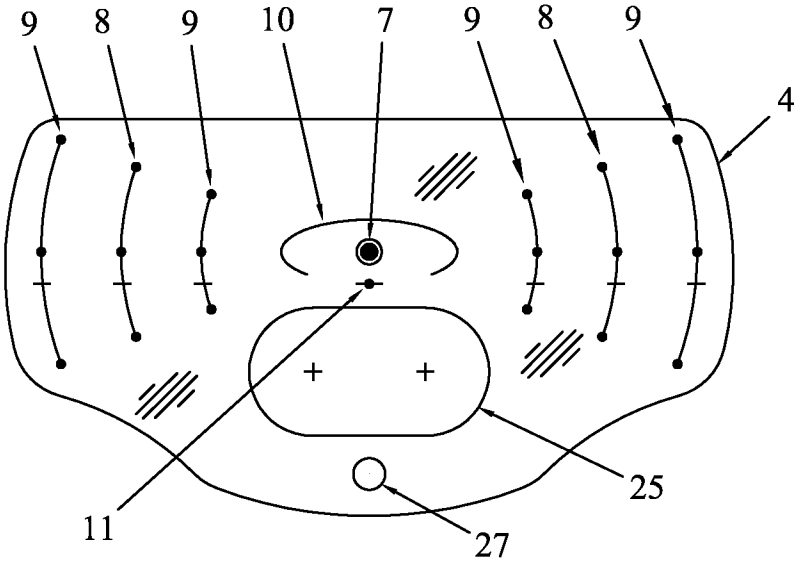
FIG. 25 shows one type of double barrel sight plate separate of the barrel attachment to show clarity.
Figure 28:
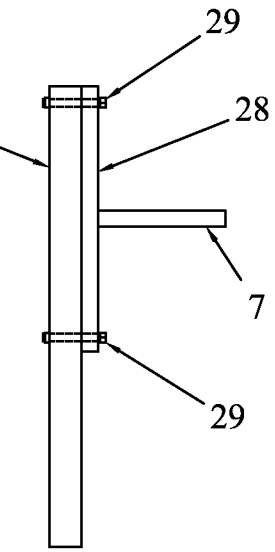
FIG. 28 shows the side view of the adjustable sight plate as depicted in FIG. 27
Figure 27:
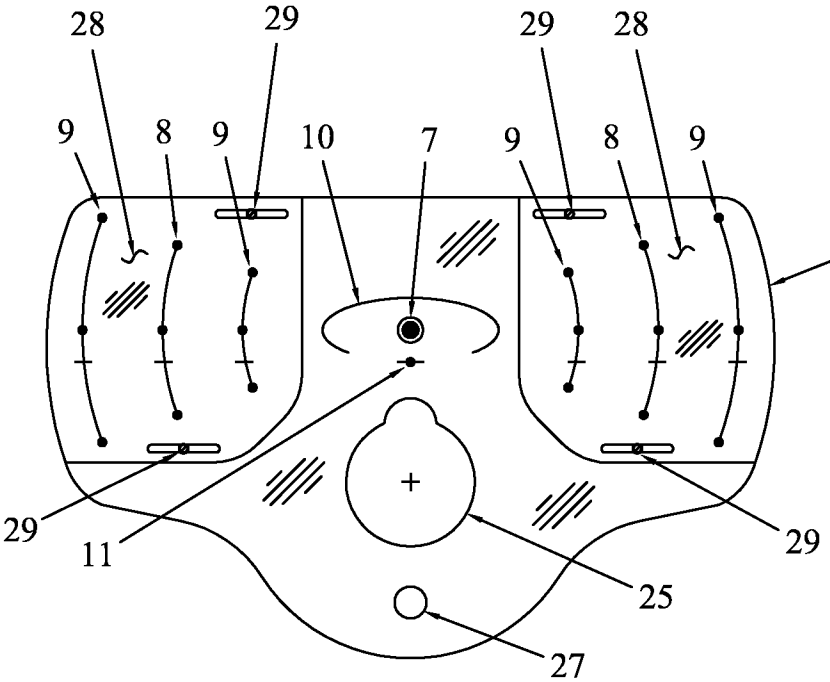
FIG. 27 shows an example of the adjustable sight plate which would allow the shooter to make field adjustments without removing and replacing the sight plate all together.
Figures 29, 30:
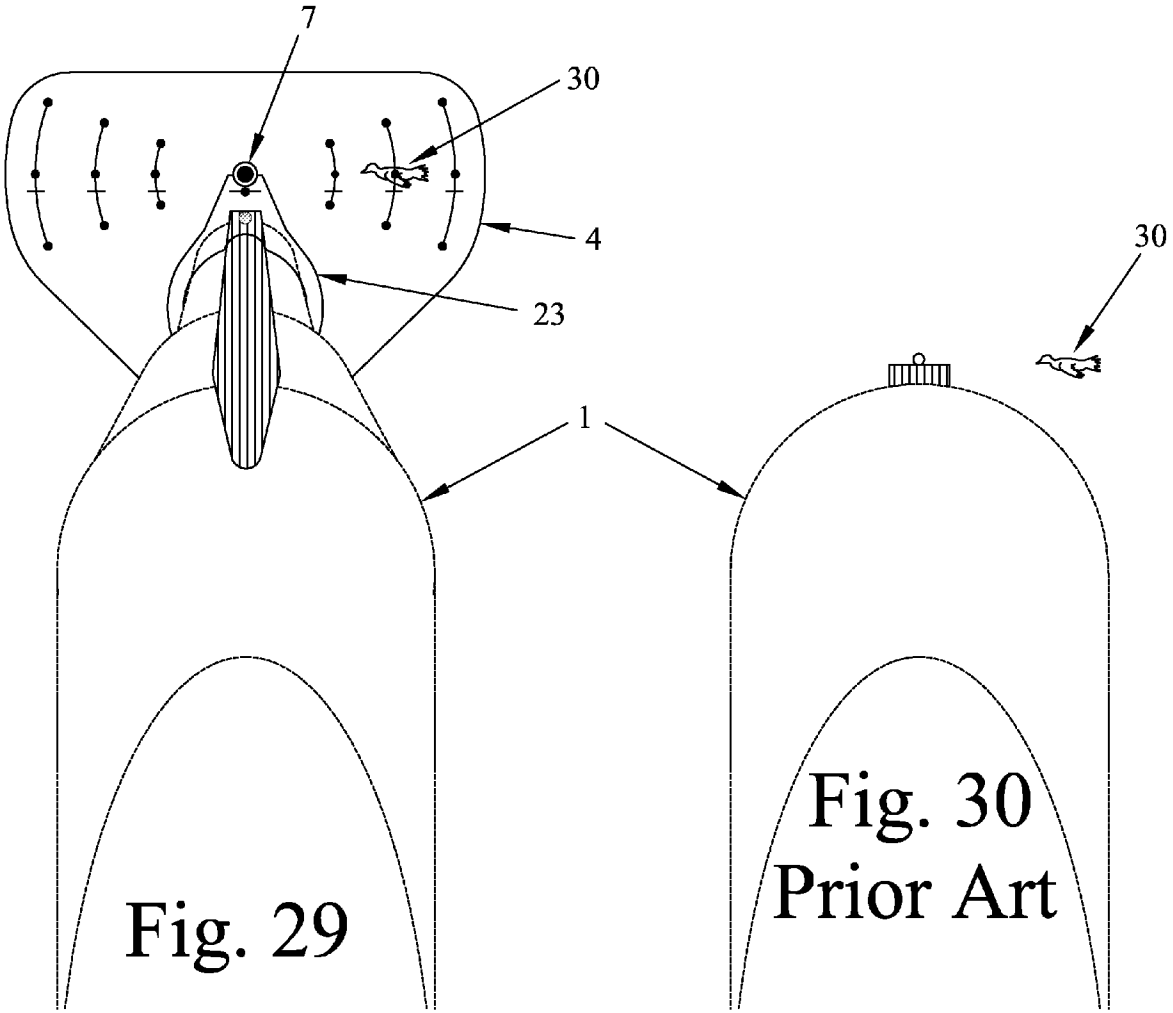
Fig. 30 Prior Art
FIG. 29 shows the shooters perspective view while tracking a moving target using this inventive idea. In this example a dove silhouette from a distance of approximately 30 yards to illustrate advantages of the invention. As illustrated, the shooter's field of view and target perspective is much improved over a standard shotgun with a ribbed barrel as shown in FIG. 30.
FIG. 30 (prior art) shows the shooters perspective view while tracking a moving target without the use of this inventive idea.
Figures 31, 32:
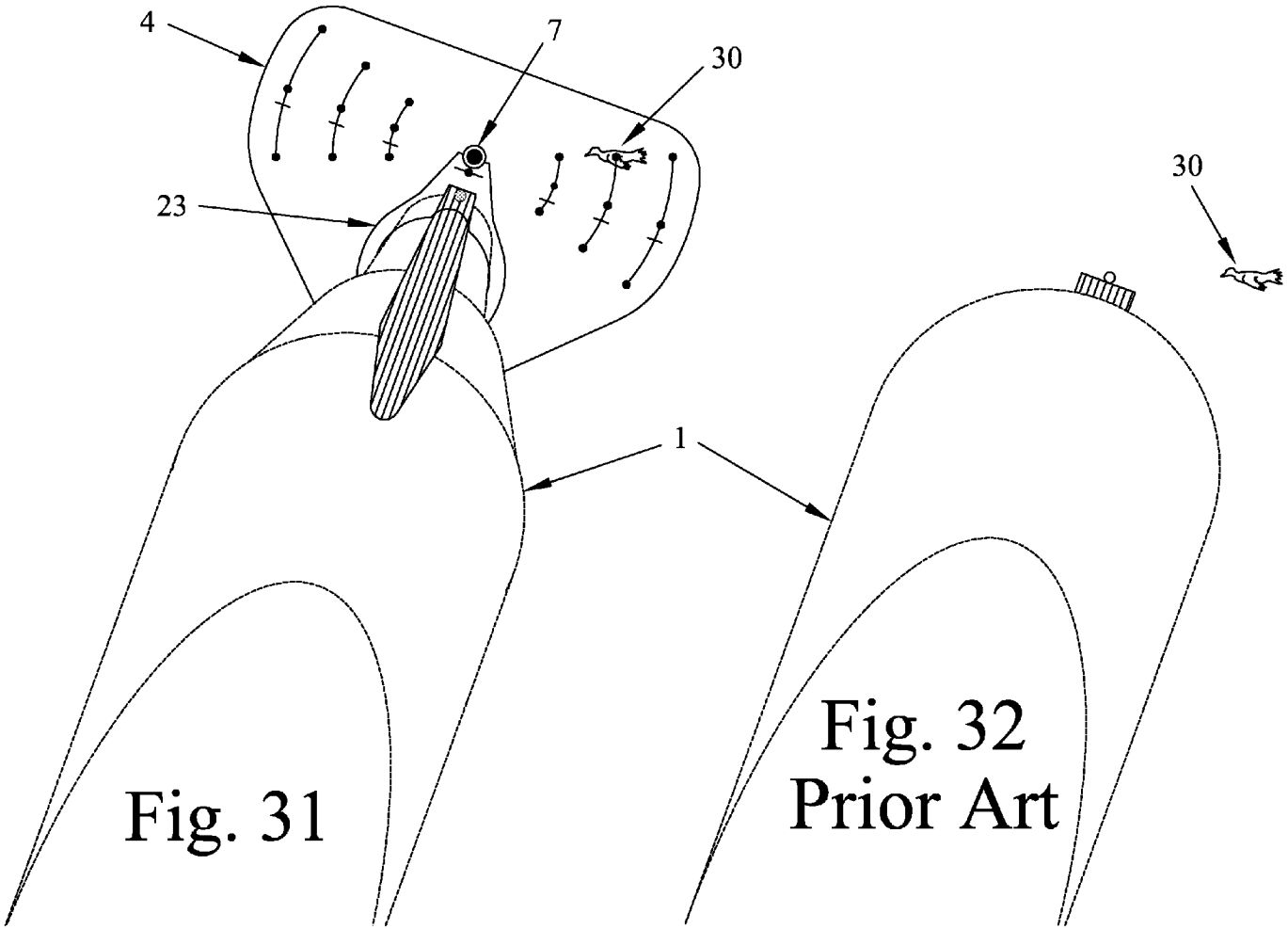
Fig. 32 Prior Art
FIG. 31 is typical to FIG. 29 except that it depicts an angled shot in order to show the much improved field of view while using this inventive idea.
FIG. 32 (prior art) shows the shooters perspective view while tracking a target through an angled shot without the use of this inventive idea.

The longitudinal axis of the pin is generally positioned at a distance in the range of 1 to 3 times the second diameter from the longitudinal axis of the shotgun barrel. In the case of a single barrel shotgun, (see FIG. 3, for example) the longitudinal axis of the pin is generally positioned at a distance in the range of 1 to 2 times the second diameter from the longitudinal axis of the shotgun barrel. In the case of an over and under shotgun, mounting means mounts the plate to a lower barrel and the longitudinal axis of the pin is generally positioned at a distance in the range of 2 to 3 times the second diameter from the longitudinal axis of the shotgun barrel. See FIG. 6. In the case of a double barrel shotgun, the mounting means mounts the plate to at least one side barrel of a double barrel shotgun and the longitudinal axis of the pin is positioned at a distance in the range of 1.5 to 2.5 times the second diameter from the longitudinal axis of the shotgun barrel. See FIG. 11.

Preferably, a circle 65 having a third diameter is marked on the clear plate centering the pin. More preferably, the third diameter is in the range of 1.05 to 5 times the first diameter, and most preferably the third diameter is in the range of 1.1 to 2 times the first diameter. A circle with a diameter of about 1.2 times the first diameter has been used with good results. See FIG. 5. Alternatively, the pin could be tubular. Or the circle itself could serve as an aiming point in the absence of the pin where a mid-barrel or rear sight is used. The arrangement permits the shooter, by alignment of the pin in the circle, or so as to be able to see through the tube if used, to position his/her eye in a precise location, where it can function as a rear gun sight. Once this is done, additional markings on the plate can be taken advantage of.

Preferably, the additional marks comprise a first pair of arcs 8 marked on the clear plate diametrically centering the pin. The first pair of arcs is centered on a line 75 passing normally though the plane 70 defined by axis of the pin and the axis of the barrel. The mounting borehole for the plate is also on this line. See FIG. 5. The first pair of arcs is preferably taken from a circle having a fourth diameter in the range of from 2 to 6 times the second diameter, preferably in the range of from about 3 to about 5 times the second diameter. In many cases, the first pair of arcs is taken from a circle having a fourth diameter which is about 4 times the second diameter. For example, in the case of a 12 gauge shotgun where the shooter's eye is positioned about 42 inches from the plate.

In a preferred embodiment, a second pair 9 of arcs is marked on the clear plate diametrically centering the pin. The second pair of arcs is centered on a line passing normally though the plane defined by axis of the pin and the axis of the barrel and is positioned radially outside of the first pair of arcs. It can be used for faster targets, or distant targets, still marginally within range. The second pair of arcs can be taken from a circle having a fifth diameter generally in the range of about 1.1 to about 1.5 times the fourth diameter, usually about 1⅓ times the fourth diameter.

In a further preferred embodiment, a third pair 9' of arcs is marked on the clear plate diametrically centering the pin. The third pair of arcs is centered on a line passing normally though the plane defined by axis of the pin and the axis of the barrel and radially inside of the first pair of arcs. The third pair of arcs is generally taken from a circle having a sixth diameter in the range of about 0.5 to about 0.9 times the fourth diameter, usually about ⅔ times the fourth diameter.

The pairs of arcs are preferably crescent-shaped and face each other.

It will be appreciated that various specialty plates can be set up for different applications. For example, pheasants are typically engaged at greater distances than quail, and a pheasant hunter would benefit from a plate set up specifically for pheasant shooting. Passing birds such as ducks and geese have a greater apparent lateral speed, or relative angular speed, than is typical for flushed birds, and are typically at greater distances, so waterfowl hunters would benefit from specialty plates set up specially for their typical shots.

In a further preferred embodiment, a dot 11 is marked on the clear plate between the pin and the longitudinal axis of the barrel at a distance of from about 0.2 and 0.8 times the second diameter from the pin. Usually, the dot is at a distance of about ⅓ times the second diameter from the pin. The dot serves as a drop compensation mark when the shooter's eye is properly positioned, at about the maximum effective range of a shotgun. Say 60 yards. If desired, first elevation marks 80 can be provided on the clear plate in alignment with the pin and second elevation marks 85 on the clear plate in alignment with the dot. Turkey hunters, for example, could benefit from the dot 11 marking.

In a further preferred embodiment, a loop 10 is marked on the clear plate centering the pin. The loop is at a location inside of the third pair of arcs. The loop serves as a slow target sight. The loop is preferably taken from a circle or ellipse. An ellipse having a major axis of about 1 to about 3 times the second diameter and a minor axis of about 0.3 to 1 times the second diameter can be used. The minor axis lies on the plane 70 defined by axis of the pin and the axis of the barrel. The elliptical arc is preferably incomplete at a location between the axis of the pin and the axis of the barrel, to avoid creating confusion with the drop compensation sight.

The mounting means in a preferred embodiment comprises a saddle body 5 having a longitudinal axis, a lateral generally cylindrical concave side surface 90 forming a saddle for saddling the at least one barrel and an end surface 95 for mounting the clear plate, and clamp means 100 for urging the saddle body against the at least one barrel. A screw 12 penetrates a borehole near a periphery of the plate and attaches the clear plate to the end surface of the saddle body. The saddle body preferably has a pair of planar surfaces 105, 105' positioned generally normal to each other and extending from the generally concave side surface. At least one clamp arm 6 mounted to each of the planar surfaces, each clamp arm having a flat surface mounted against the planar surface of the saddle body and a generally cylindrical concave surface 110 generally juxtaposed to the concave surface of the saddle body. At least one screw 13 is positioned for urging the flat surface of each clamp arm against the planar surface of the saddle body to urge the concave surfaces toward each other and provide clamping action to the barrel. The concave surfaces are preferably generally cylindrical and preferably generally correspond in diameter to the barrel being clamped.

If desired, a mid sight 3 can be provided mounted near a midsection of the shotgun barrel. The mid sight can be formed of a second clear plate having a notch on its upper periphery for alignment with the pin or aiming point on the plate to facilitate proper head positioning by the shooter. It can be mounted in the same manner as the front sight. The axis of the barrel is generally parallel to a line drawn between the notch and the pin or aiming point to facilitate hitting the target.

For use, the user shoulders the shotgun and aligns his/her head so that the pin is aligned with an eye. Then, while maintaining the eye/pin alignment, the shooter tracks a flying target with the shotgun, points the shotgun ahead of the target, superposes an arc of the first pair of arcs on the target, and discharges the shotgun.

Preferred embodiments of the invention provide an elevated gun sighting device and method that can be used to enhance a shooter's ability to hit moving as well as stationary targets. This device attaches near the muzzle end of the barrel and may be used in conjunction with a mid-barrel support sight attached to the barrel near the fore-arm. The main sighting device consist of two basic components but may vary slightly depending on the embodiment: (1) mounting means to attach the sight to the barrel, typically comprising a support saddle or rib support bracket and an adjustable attachment clamp or side barrel attachment clamps, and (2) a sight plate that holds the multi-function sight preferably along with the optimal, marginal, slow speed and drop compensation sights. The multi-function sight is attached to the sight plate and is elevated from the main gun barrel sight. On both sides of the multifunction sight is preferably one optimal target sight and on both sides of each optimal target sight is one marginal target sight. On some embodiments there may be a slow speed target sight loop which is located between the multi-function and the marginal sights. Directly below the multi-function sight is preferably the drop compensation sight.

The optimal, marginal and slow speed target sights are located in general alignment between the shooters view point and the calculated lead point for hitting a flying target where it intersects the sight plate. Some embodiments attach directly to the gun barrel using the support saddle while others use a rib support bracket, both of which are preferably attached to the barrel by the adjustable attachment clamp or the side barrel attachment clamps. Some embodiments use a clear or transparent sight plate such as Lexan (R) (polycarbonate) or other transparent materials whereby the sights are attached, marked, printed, etched, stamped or affixed by other means. Other parts are made of hardened materials such as steel, aluminum, hard plastics or other similar materials, as appropriate. Gasket, rubber or other similar insulating and non-slip materials may be used as a cushion and insulator between parts if desired that come in direct contact with the barrel.

The mid-barrel sight when used attaches to the barrel in similar fashion as the main sight and is used to help level and aim the multi-function sight. This sight is also transparent and adjustable and may also be used as a drop compensation sight.

One embodiment of the invention utilizes the support saddle which attaches to the underside of the barrel and then compressed by the adjustable attachment clamp or side barrel attachment clamps until the unit is secure. Other embodiments utilize the rib support bracket which is saddled onto the barrel rib and then compressed by the adjustable attachment clamp until the unit is secure. Attached to the front side of the support saddle embodiment and the support bracket embodiment is the transparent sight plate.

Attached, marked or affixed onto the sight plate is pin, which serves as the multi-function sight. This sight is very unique in that it provides several different functions: (1) It serves as the main gun sight and is not only excellent for moving targets but is also an excellent gun sight for still targets as well. (2) It's an excellent sight for both point shooters that like to shoot with both eyes open as well as sight shooters that aim or sight with one eye closed. (3) The sight is elevated up from the main barrel sight which provides the shooter with an excellent field of view and perspective of the target. (4) it also serves as an excellent leveling/alignment sight due to its elongated shape with the centering circle positioned around the shaft of the sight in the direction of the muzzle end.

Also marked, printed, stamped, etched or affixed by other means onto the sight plate are the optimal, marginal (fast or slow), slow speed and drop compensation sights. The different sights can be marked in different colors.

This inventive method of locating and positioning these sights onto the sight plate is through the process of taking specific field conditions and averaging the natural variables associated with those conditions such as target speeds, distances, altitudes and angles of flight to determine the most common target speed and distance. Once the most common target speed and distance are determined, they are then used in conjunction with various types of ammunition ballistics to calculate the optimal lead distance for that particular field condition. The lead for the most common speed and distance is the optimal lead distance which is then marked, printed, stamped, etched or affixed by other means onto the sight plate where it intersects the line of sight between the shooters eye and the optimal lead point. This establishes the location of the optimal target sight.

Once the optimal sight marking is established then the marginal fast and slow and very slow speed sights can be easily defined. The marginal and slow speed sights are calculated to reflect a specific percentage of speed increase and decrease of the optimal sight thereby effectively spreading the shot pattern by using each sight as a hard reference. This effective and even spread of the shot pattern is especially beneficial for consecutive shots made by the shooter.

The optimal, marginal faster or slower and slow speed sights are designed as a circular arch representing a circular radius around the multi-function sight. This arch design allows the shooter to quickly adjust from a perpendicular shot to an angled shot without over complicating the process.

On some embodiments the optimal and marginal sights are adjustable which allows the shooter to make field adjustments without the need to replace the sight plate with optimal sights that are more conducive to existing field conditions.

Sight plates can be designed to meet the requirements of many different field conditions and ballistic requirements for all types of wing hunting as well as target shooting using moving targets. This will give the shooter the possibility of taking an array of sight plates into the field for quick and easy exchange for changing field conditions. Sight plates can also be designed with different symbols, markings and colors as a preference option for all shooters.

Some embodiments of the invention will only include the multi-function sight. This option will be extremely useful when shooting stationary or slow moving ground targets. It also provides the shooter with an excellent sight for either point shooting or sight shooting. In addition, it also provides the shooter with an improved field of view.

The sport of wing hunting and target shooting using moving targets begs the need for this exemplary inventive idea because it addresses many of the fundamental challenges associated with the sport. It was also designed and tested with special consideration in mind for making this gun sight user friendly and practical use by all shooters with special emphasis as a training aid for novice shooters and youngsters alike. This inventive device and method is also an excellent gun sighting device for those that must wear eyeglasses and for those handicapped in ways that make it difficult for them to use conventional gun sights.

Reiterating some of the exemplary and unique qualities of this inventive idea; (1) it improves the shooter's ability to quickly and precisely level the barrel onto the flight path of the target, (2) it improves the shooter's field of vision and perspective of the target (3) it simplifies the shooter's target acquisition by providing an optimal target sight that is calculated based on averaging the natural variables and ballistics of the ammunition (4) it minimizes the data providing on the sighting device to make the device user friendly and practical for even the most novice shooters (5) it's sophisticated yet simple design allows the shooter to move through three consecutive shots in seconds and with precision (6) the multi-function sight and its location thereof is designed to be used by shooters that point shoot with both eyes open or by the sight shooter with one eye closed (7) sight plates are easily removed and exchanged in the field (8) some sight plates have adjustable sights which allow the shooter to make field adjustments without changing the whole sight plate.

REFERENCES NUMERALS USED IN THE DRAWINGS

1. Generic single barrel shotgun
2. Support saddle embodiment completely attached
3. Mid sight (mid barrel support sight)
4. Transparent sight plate
5. Saddle body
6. Clamp arm (Side barrel attachment clamp)
7. Pin
8. First pair of arcs (Optimal sight)
9. Second pair of arcs (Marginal sight)
9'. Third pair of arcs (Marginal sight)
10. Loop (Slow target sight)
11. Dot (Drop compensation sight)
12. Sight plate attachment screw for certain embodiments
13. Side clamp attachment screw
14. Generic over and under shotgun
15. Generic double barrel shotgun
16. Support saddle for adjustable attachment clamp
17. Adjustable attachment clamp
18. Wing nut
19. Rib support bracket
20. Support saddle embodiment shown for clarity
21. Support saddle for the mid-barrel support sight
22. Side barrel attachment clamp for mid-barrel support sight
23. Mid-barrel support sight plate
24. Attachment and adjustment slot.
25. Barrel cutout
26. Cutout for multi-function sight
27. Sight plate attachment hole
28. Adjustable sight plate overlay
29. Adjustable sight plate screws
30. Dove silhouette (example bird)
35. Sight
40. Barrel
45. Barrel longitudinal axis
50. Mounting means
55. Shotgun
60. Pin longitudinal axis
65. Circle around pin
70. Plane defined by axis of pin and axis of barrel
75. Line normal to plane 70
80. Elevation marks corresponding to pin
85. Elevation marks corresponding to dot
90. Saddle body concave side surface
95. Saddle body end surface
100. Clamp means
105. Planar surface
110. Concave surface While certain preferred embodiments have been described herein, the invention is not to be construed as being so limited, except to the extent that such limitations are found in the claims.

What is claimed is:

1. A shotgun sight comprising:
a clear plate,
a pin extending generally normally from the plate, said pin having a first diameter and a longitudinal axis,
a mounting means attached to the plate for mounting the plate to a shotgun comprising a barrel having a second diameter, said barrel having a longitudinal axis positioned parallel to the longitudinal axis of the pin,
said shotgun sight further comprising a circle having a third diameter marked on the clear plate centering the pin,
and a dot marked on the clear plate between the pin and the longitudinal axis of the barrel at a distance of from about 0.2 and 0.8 times the second diameter from the pin.

2. A shotgun sight as in claim 1 wherein
the second diameter is in the range of 3 to 30 times larger than the first diameter.

3. A shotgun sight as in claim 1 wherein
the longitudinal axis of the pin is positioned at a distance in the range of 1 to 3 times the second diameter from the longitudinal axis of the shotgun barrel.

4. A shotgun sight as in claim 1 wherein the third diameter is in the range of
1.05 to 5 times the first diameter.

5. A shotgun sight as in claim 1 further comprising a first pair of arcs marked
on the clear plate diametrically centering the pin, said first pair of arcs being centered on a line passing normally though the plane defined by axis of the pin and the axis of the barrel.

6. A shotgun sight as in claim 5 wherein the first pair of arcs is taken from a circle having a fourth diameter in the range of from 2 to 6 times the second diameter.

7. A shotgun sight as in claim 6 further comprising a second pair of arcs marked on the clear plate diametrically centering the pin, said second pair of arcs being centered on a line passing normally though the plane defined by axis of the pin and the axis of the barrel and radially outside of the first pair of arcs.

8. A shotgun sight as in claim 7 wherein the second pair of arcs is taken from a circle having a fifth diameter in the range of about 1.1 to about 1.5 times the fourth diameter.

9. A shotgun sight as in claim 7 further comprising a third pair of arcs marked on the clear plate diametrically centering the pin, said third pair of arcs being centered on a line passing normally though the plane defined by axis of the pin and the axis of the barrel and radially inside of the first pair of arcs.

10. A shotgun sight as in claim 9 wherein the third pair of arcs is taken from a circle having a sixth diameter in the range of about 0.5 to about 0.9 times the fourth diameter.

11. A shotgun sight as in claim 10 further comprising, in combination, a shotgun comprising a barrel having the second diameter, and a stock, wherein
the mounting means mounts the plate normally to the shotgun barrel at a location near the muzzle for visibility above the barrel for a shooter having an eye positioned above the stock, wherein the pin extends toward an eye of a shooter so positioned.

12. A shotgun sight as in claim 9 further comprising in combination, a shotgun comprising a barrel having the second diameter, and a stock, wherein the mounting means mounts the plate normally to the shotgun barrel at a location near the muzzle for visibility above the barrel for a shooter having an eye positioned above the stock, wherein the pin extends toward an eye of a shooter so positioned.

13. A method of shooting a shotgun sight and combination as in claim 12, said method comprising shouldering the shotgun, aligning one's head so that the pin is aligned with an eye, and, while maintaining the eye/pin alignment, tracking a flying target with the shotgun, pointing the shotgun ahead of the target, superposing an arc of the first pair of arcs on the target, and discharging the shotgun.

14. A shotgun sight as in claim 1 wherein the shotgun comprises at least one barrel, and the mounting means comprises a saddle body having a longitudinal axis, a lateral generally cylindrical concave side surface forming a saddle for saddling the at least one barrel and an end surface for mounting the clear plate, and clamp means for urging the saddle body against the at least one barrel.

15. A shotgun sight as in claim 14 wherein the saddle body has a pair of planar surfaces positioned generally normal to each other and extending from the generally concave side surface, at least one clamp arm mounted to each of the planar surfaces, each clamp arm having a flat surface mounted against the planar surface of the saddle body and a generally cylindrical concave surface generally juxtaposed to the concave surface of the saddle body, and at least one screw urging the flat surface of the each clamp arm against the planar surface of the saddle body to urge the concave surfaces toward each other and provide clamping action to the barrel.

16. A shotgun sight as in claim 1 further comprising, in combination, a shotgun comprising a barrel having the second diameter, and a stock, wherein the mounting means mounts the plate normally to the shotgun barrel at a location near the muzzle for visibility above the barrel for a shooter having an eye positioned above the stock, wherein the pin extends toward an eye of a shooter so positioned.

17. A combination as in claim 16 further comprising a middle sight mounted near a midsection of the shotgun barrel, said middle sight comprising a second clear plate having a notch on its upper periphery to facilitate proper head positioning by the shooter.

* * * * *